US007743829B2

(12) United States Patent
Kirk et al.

(10) Patent No.: US 7,743,829 B2
(45) Date of Patent: Jun. 29, 2010

(54) CEMENT FLOW CONTROL TOOL

(75) Inventors: Ian Alastair Kirk, Milltimber (GB); William Barron, Bieldside (GB); Alistair Bertram Clark, Westhill (GB)

(73) Assignee: Downhole Products plc (GB)

( * ) Notice: Subject to any disclaimer, the term of this patent is extended or adjusted under 35 U.S.C. 154(b) by 994 days.

(21) Appl. No.: 10/531,858

(22) PCT Filed: Oct. 23, 2003

(86) PCT No.: PCT/GB03/04588

§ 371 (c)(1),
(2), (4) Date: Apr. 19, 2005

(87) PCT Pub. No.: WO2004/038172

PCT Pub. Date: May 6, 2004

(65) Prior Publication Data

US 2006/0000993 A1 Jan. 5, 2006

(30) Foreign Application Priority Data

Oct. 23, 2002 (GB) ..... 0224654.4

(51) Int. Cl.
*E21B 33/13* (2006.01)

(52) U.S. Cl. ..... 166/285; 166/177.4

(58) Field of Classification Search ..... 166/285, 166/286, 300, 162, 177, 177.4; 138/142, 138/39; 251/126; 137/808, 809
See application file for complete search history.

(56) References Cited

U.S. PATENT DOCUMENTS

| | | | | | |
|---|---|---|---|---|---|
| 1,959,368 | A | | 5/1934 | Benton | |
| 2,178,846 | A | * | 11/1939 | Baker | 166/222 |
| 3,351,136 | A | | 11/1967 | Nelson | |
| 3,727,691 | A | * | 4/1973 | Muecke et al. | 166/295 |
| 4,083,406 | A | * | 4/1978 | Metz | 166/286 |
| 5,346,007 | A | * | 9/1994 | Dillon et al. | 166/278 |
| 5,570,744 | A | * | 11/1996 | Weingarten et al. | 166/357 |
| 6,311,774 | B1 | * | 11/2001 | Brockman et al. | 166/285 |
| 6,723,158 | B2 | * | 4/2004 | Brown et al. | 96/214 |

OTHER PUBLICATIONS

"Downhole Choke for Cementing Operations"—XLTL.com (undated).

Flow Master Cement Set— 3 pgs. (undated).

* cited by examiner

*Primary Examiner*—David J Bagnell
*Assistant Examiner*—Brad Harcourt
(74) *Attorney, Agent, or Firm*—Drinker Biddle & Reath, LLP

(57) ABSTRACT

An apparatus for controlling the flow of fluid into a borehole through a conduit has a decelerating means adapted to be positioned within the conduit. The fluid could typically comprise drilling mud and/or cement, and in some embodiments, some of the cement can exit through apertures in a shroud of the apparatus to cement the decelerating means inside the conduit.

32 Claims, 5 Drawing Sheets

10
12
14
16
20
30
31
32
34
36
40
41
42
44
46
50
52
54
55
56
58
60
62
64
68
69
70
80
82
84
86
86a
86b
88
89

CEMENT FLOW CONTROL TOOL

FIELD OF THE INVENTION

The present invention relates to a cement flow control tool and especially but not exclusively, a cement flow control tool for use in cementing a string of tubulars such as a casing or liner string into an oil, gas or water borehole.

DESCRIPTION OF THE RELATED ART

Primary cementing is the process of placing cement in the annulus between a casing or liner string and the formations exposed to the borehole. A major objective of primary cementing is to provide zonal isolation in the borehole of oil, gas, and water wells, i.e. to exclude fluids such as water or gas in one zone from oil in another zone. To achieve this, a hydraulic seal must be obtained between the casing and the cement, and between the cement and the formations, while at the same time preventing fluid channels in the cement sheath. Without complete zonal isolation, the well may never reach its full producing potential and remedial work to repair a faulty cementing job may do irreparable harm to the producing formation. In consequence, reserves may be lost and commencement of production may be delayed.

After drilling the well to the desired depth, the drillpipe is removed and a casing string is run in until it reaches the bottom of the borehole. The casing string typically has a shoe, such as a float shoe, guide shoe or a reamer shoe on the end to guide the casing string into the borehole. At this time, the drilling mud (used to remove formation cuttings during the drilling of the well) is still in the borehole; this mud must be removed and replaced by hardened cement.

This is done by passing cement down through the inside of the casing string; the cement passes out of apertures in the shoe and into the annulus between the borehole and the casing. The drilling mud is displaced upwards and the cement replaces it in the annulus. The cement needs to extend at least as far up the annulus so as to span the production zones, and the previous casing shoe if present, and sometimes the cement even extends to the surface.

However, the cement is heavy and so exerts a large force on the drilling mud. Drilling mud is less heavy than cement, so the cement causes the drilling mud to travel quickly up the annulus. Fast flowing drilling mud brings a high pressure to bear upon the formation and excess solids and drill cuttings may build up in the annulus, exerting even more pressure on the formation. The formation may break down under the pressure, resulting in both severe mud loss and also a loss of production. Open hole sections of the formation are especially prone to collapse, possibly ruining the borehole.

An additional problem is that the cement, being heavier, may also fall down through the drilling mud, resulting in a poor cement job.

BRIEF SUMMARY OF THE INVENTION

According to the present invention there is provided apparatus for controlling the flow of cement into a borehole through a conduit, the apparatus comprising a decelerating means adapted to be positioned within the conduit for slowing down the flow of fluid through the conduit.

The deceleration means typically controls or mitigates the free fall effect of the cement.

Preferably, the conduit is a drillpipe, tubing, coiled tubing, filtration screen, casing or liner string, but may be any conduit which is inserted into a borehole.

Typically, the decelerating means comprises a passage, and most preferably, the passage is defined by at least one body member having formations thereon.

Typically, the passage is inclined relative to the axis of the conduit and deceleration of the fluid is caused by friction between the fluid and the inclined passage. Typically, the passage is also inclined relative to a plane perpendicular to the axis of the conduit. Optionally, the inclination of the passage is continual throughout its length.

Typically, the inclined passage has constant dimensions and the boundaries of the passage are free of obstructions so that the fluid moves along the passage without hindrance.

The passage typically comprises portions with axial and transaxial components, so that the length of the passage is greater than the length of the apparatus.

The transaxial components of the passage typically cause the path of fluid flowing through the apparatus to deviate from its former axial path through the conduit prior to flowing through the apparatus, thereby decelerating the fluid.

Preferably, the decelerating means further comprises at least one spiral passage defined by the at least one body member.

The angle of the spiral portion of the passage is typically more than 60 degrees relative to the conduit axis, preferably between 70 and 80 degrees and most preferably around 75 degrees.

Preferably, the passage is uni-directional in the axial direction, so that in use, when fluid is flowing from the top to the bottom of the internal passage, no part of the passage would direct fluid up the apparatus.

Uni-directional embodiments have the advantage over other designs which include passages having upwardly-inclined portions and corresponding troughs, in which any suspension would be inclined to settle and block the passage.

Such uni-directional embodiments include those having a spiral passage; the continual slope of the spiral passage ensures that gravity can assist the flow of fluid through the passage. Embodiments incorporating the spiral design have the advantage that any suspended particles carried by the fluid will not settle in the passage and block the passage.

Optionally, the passage includes at least two portions spiralling in opposite directions to each other. Optionally, the spiral passage includes at least two of said portions and preferably oppositely directed spiralling portions are positioned adjacent one another.

Preferably, the passage includes two or more of said portions and most preferably, the passage is formed so that fluid travelling through a first portion will flow in a clockwise direction through the spiralling parts of that portion, and fluid travelling through a second, neighbouring portion will flow in an anti-clockwise direction through its spiralling portion, or vice versa.

Typically, the decelerating means induces turbulence into the fluid to decelerate the fluid.

Optionally, the turbulence is wholly, mainly or partly induced by a direction-altering means, which changes the direction of fluid flowing in the internal passage. Typically, the direction-altering means comprises a cavity provided between first and second oppositely directed spiral passage portions, providing a space in which the fluid changes direction between the first spiral direction and the second spiral direction. The cavity is typically formed in the at least one body member and may comprise a connecting passage linking the spiral passage portions; the connecting passage may include axial portions and transaxial portions.

Whether turbulent or laminar flow results depends (among other parameters) on the speed of the fluid through the passage. Thus, in embodiments of the invention which induce turbulence, the apparatus can have a decelerating effect on some fluids but not on others, depending on the speed of the fluid. The turbulence will only have a significant effect upon fast flowing fluids and slow flowing fluids will not be appreciably slowed.

However, simple embodiments of the invention, which may comprise a member forming a simple spiral passage or an alternative form of passage inclined relative to the conduit axis, can optionally decelerate fluids without any inducing any significant turbulent effect.

Optionally, the spiral passage is tightly wound, so that the spiral passage is longer than the conduit in which it is positioned, and preferably considerably longer. The angle of the spiral passage in these tightly wound embodiments can be between 75 degrees and 90 degrees to the conduit axis. Such embodiments can cause fluids to be decelerated due to forcing the fluids to continually change direction in the (in use) horizontal plane orthogonal to the axis. As the fluids travel in the circular plane, they will typically collide with the outer wall of the conduit, or any sleeve or shroud surrounding the passage, and they will be decelerated by friction between the fluids and that interface. This can be in addition, or instead of, any turbulent effect.

As explained above, embodiments including a spiral passage have the advantage that gravity assists the flow of fluids along the passage and that any suspension in the fluids is prevented from settling out, due to the continuing slope of the passage.

Optionally, the body members connect by interlocking means, which may include tongues and grooves.

Optionally, the at least one body member is cemented or otherwise fitted inside the casing or liner string.

Typically, the apparatus is used in conjunction with equipment, such as a shoe and/or a float collar, at least one of which is provided with a valve (typically a one-way valve). Preferably, the cross-sectional area of the flow path through the passage is greater than the cross-sectional area of the flow path through the valve.

If the valve is provided in the float collar, and in use, the float collar is located above the apparatus, then this prevents the apparatus from having a choke effect on any fluids passing through it. As the area of the passage is greater than that of the valve, the passage does not create a bigger restriction to the flow of fluid than has already been created by the valve and the fluid is not "choked" by the passage.

Thus, in such embodiments, the rate of fluid leaving the shoe and the deceleration of the fluid is not limited by the cross-section of the passage, only by the amount of turbulence or other decelerating effect created by the apparatus.

Optionally, the apparatus includes at least one collar attached to an end (preferably the lower end) of the casing or liner string, the collar having screw threads for attachment to further sections of casing or liner.

The collar can replace the shoe at the (in use) lower end of the apparatus. The collar may couple the casing or liner tubular within which the apparatus is inserted to further casing or other equipment, in the case that another piece of equipment is required directly above the shoe.

A conventional coupling is typically used to attach the (in use) upper end of the casing or liner tubular within which the apparatus is located to the rest of the casing or liner string.

Preferably, the apparatus comprises an anti-rotation means to prevent relative rotation of the body members and thus the passage and the shoe. Typically, the anti-rotation means includes a device, which may be a sub, shaped to engage a bore provided in the shoe. Preferably, an axial locking means is provided to prevent axial separation of the device and the shoe. Preferably, the axial locking means comprises a latch provided on one of the device and the shoe, and a groove (to engage the latch) provided on the other of the device and the shoe. Most preferably, the locking means comprises a circlip provided on the device which is adapted to engage a groove in the shoe to prevent axial separation of the device and the shoe. Preferably, the anti-rotation means comprises a tapered edge provided on one of the device and the shoe and a correspondingly shaped groove provided on the other of the device and the shoe. Typically, the tapered edge is provided on the device and the groove is provided in the shoe. Typically, the anti-rotation means prevents relative rotation of the at least one body member and the shoe once the axial locking means has engaged.

The anti-rotation means is useful to help prevent or restrict the rotation of the at least one body member and thus the passage when the at least one body member is drilled through. Rotation of the passage would be disadvantageous as rotation of the drill bit could rotate the passage, if it is not firmly cemented to the casing, instead of drilling through the passage.

Optionally, the apparatus further comprises an outer protection means, which may be a shroud. Typically, the outer protection means is provided with apertures in the side wall thereof.

According to a second aspect of the present invention there is provided a control assembly, including:

control apparatus for controlling the flow of fluid into a borehole through a conduit, the apparatus comprising a decelerating means adapted to be positioned within the conduit for slowing down the flow of fluid through the conduit, the decelerating means comprising a passage in the apparatus;

a conduit in which the control apparatus is located; and a valve located in the conduit above the apparatus;

wherein the cross-sectional area of the passage in the apparatus is greater than the cross-sectional area of the valve.

Preferably, the valve is located in a float collar.

According to a third aspect of the present invention there is provided a method of controlling the passage of fluid through a conduit located in a borehole, including the step of decelerating the fluid.

Optionally, the fluid is decelerated by being passed through a decelerating means located inside the conduit, the decelerating means being adapted to decelerate the fluid passing through the conduit.

Preferably, the decelerating means is inserted into the conduit prior to running in the conduit into the borehole.

Optionally, the deceleration is caused by the fluid being forced to change direction. Optionally, the method includes the step of causing the fluid to deviate from the conduit into a passage which is inclined relative to the conduit axis. Some, or all, of the decelerating effect could be caused by friction as fluid travels along a passage in the apparatus.

Optionally, the fluid travels in a direction having a circular component, which is typically in the (in use) horizontal plane orthogonal to the axial direction.

Typically, the fluid is decelerated by causing it to travel through a passage, which may be a spiral passage, defined by the decelerating means. In use, the inclination of the spiral passage relative to the vertical enables gravity to aid the motion of the fluid through the passage, and means that any particles suspended in the fluids are unlikely to settle out in the passage to block the passage. The spiral may be tight, so that fluid will travel through a large distance in a small axial space.

Optionally, the fluid is decelerated by induction of turbulence into the fluid. This may be achieved by passing the fluid through a spiral passage including portions spiralling in opposite directions. In such embodiments, the turbulence may be induced in a connection region between the portions where fluid spiralling in one direction has to change direction and spiral in the opposite direction.

Typically, the spiral passage includes a plurality of oppositely directed spiralling portions positioned in series and the fluid passes through a plurality of connection regions as it flows through the conduit.

Optionally, the amount of turbulence induced is dependent on the speed of the fluid flow, and the turbulence induced for slowly flowing fluids may be zero or negligible.

Typically, a float collar having a valve is provided in the conduit above the inclined passage, the passage having a greater cross-sectional area than the cross-sectional area of the valve so that the fluid flows without restriction into the passage.

Typically, a shoe is attached to one end of the conduit, the shoe having a fluid outlet, and fluid is pumped or passed through the conduit and enters the borehole by the fluid outlet.

Optionally, the inclined passage is defined by at least one body member having formations thereon and a shroud having apertures in its surface is provided around the body member, and the method includes the step of passing cement through the passage, some of which exits the passage via the apertures to cement the body member to the conduit.

BRIEF DESCRIPTION OF THE SEVERAL VIEWS OF THE DRAWINGS

An embodiment of the invention will now be described by way of example only and with reference to the following drawings, in which:—

DETAILED DESCRIPTION OF THE INVENTION

Figures 1, 2, 3, 4, 5, 6, 9:
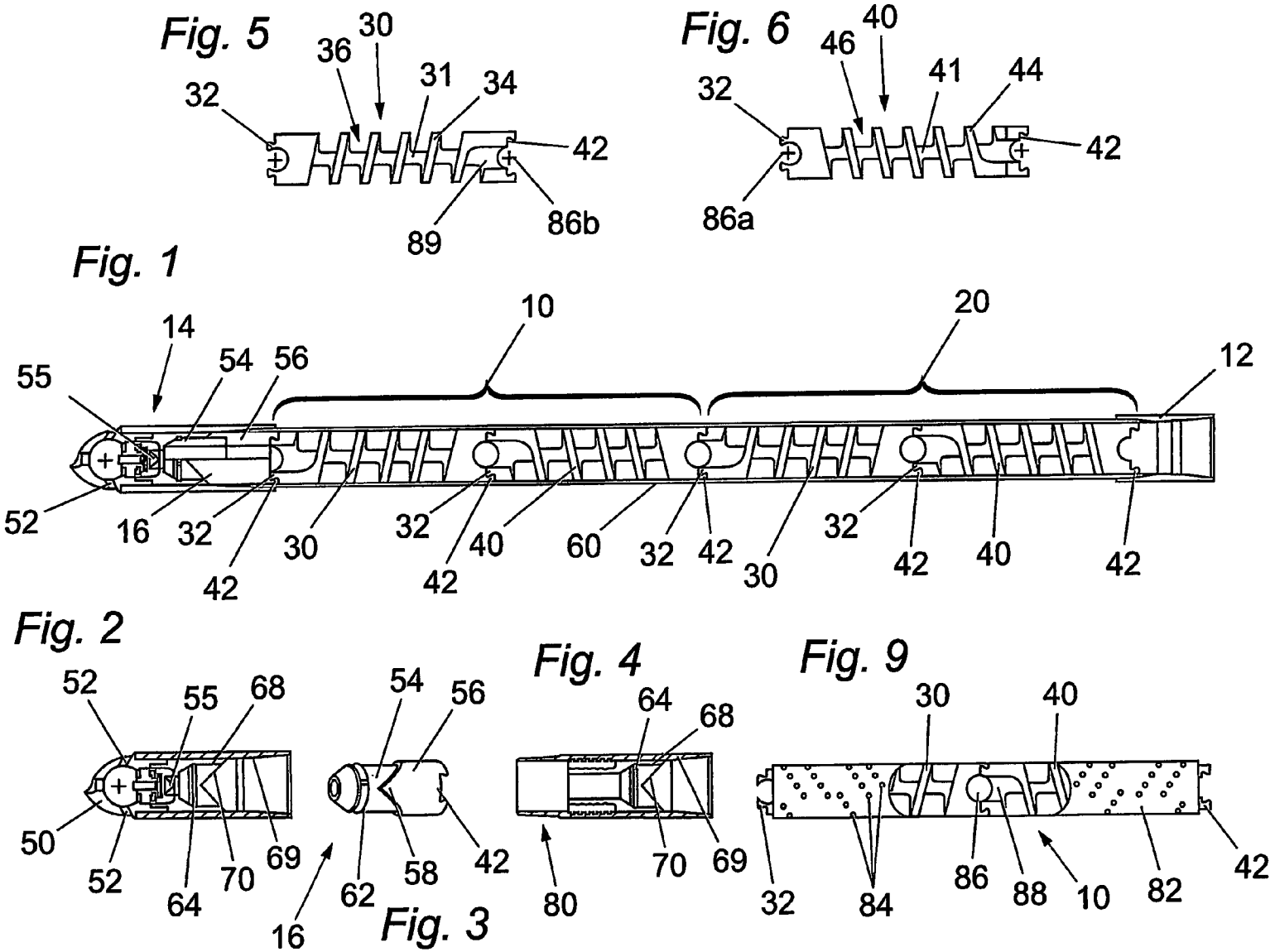
FIG. 1 shows a side view with interior detail of two cement tools stacked on top of each other and inserted in a downhole assembly between a shoe and a casing string.
FIG. 2 shows a side view with interior detail of the shoe of FIG. 1.
FIG. 3 shows a perspective view of a connector sub of FIG. 1.
FIG. 4 shows a side view with interior detail of a collar which can be used with the tool of FIG. 1.
FIG. 5 shows a side view of a first tool portion.
FIG. 6 shows a side view of a second tool portion.
FIG. 9 shows a side view with some interior detail exposed of one of the cement tools of dFIG. 1.
Figure 8:
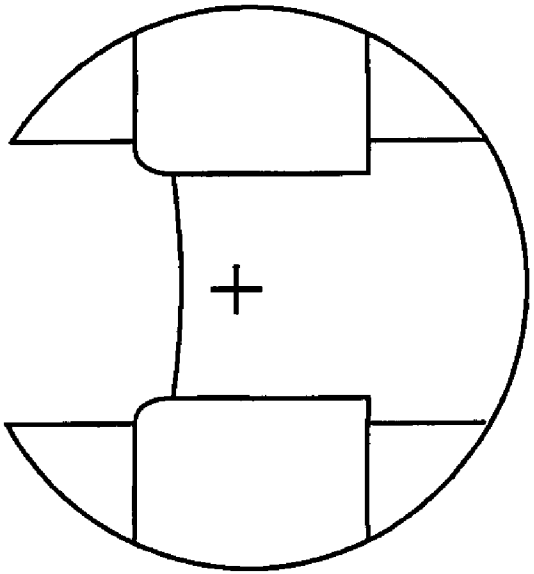
FIG. 8 shows a plan view of the front (left hand) end of the first tool portion of FIG. 5.
Figure 7:
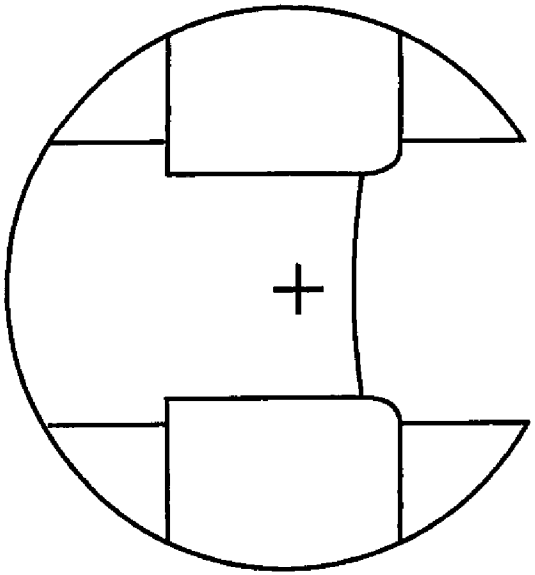
FIG. 7 shows a plan view of the rear (right hand) end of the second tool portion of FIG. 6, rotated through 180°.

FIG. 1 shows apparatus in accordance with the present invention comprising a first cement tool 10 and a second cement tool 20 coupled together. Each tool 10, 20 is made up of a first body member 30 having a left hand spiral portion and a second body member 40 having a right hand spiral portion, shown in FIGS. 5, 6, 7 and 8. It will, however, be appreciated that the left and right hand spiral portions may be swapped with one another.

The cement tools 10, 20 are located inside a length of casing 60, which has standard screw thread connections on each end. The upper end of casing 60 is connected to a casing coupling 12 which is attached to the rest of the casing string (not shown). It is not necessary for the tools 10, 20 to be located inside casing 60; the tools 10, 20 may be located inside any conduit which is inserted into the borehole, such as drillpipe, tubing, coil tubing or liner. The cement tools 10, 20, do not necessarily extend all the way up the length of casing 60 as shown in FIG. 1; the cement tools 10, 20 typically only extend approximately halfway up the length of casing 60.

Each body member 30, 40 has a central column 31, 41 with a spiral protrusion 34, 44 extending therefrom. The radially outer edge of the spiral protrusions 34, 44 extends substantially to the inner wall of the casing 60. Thus, a spiral passage 36, 46 is formed between the surfaces of the spiral protrusion 34, 44, the central column 31, 41 and the inner surface of the casing 60.

The body members 30, 40 are connected together by interengaging tongues and grooves. Each body member 30, 40 has a dove tail or tongue 32 at one end (here, the upper end with respect to the borehole) and a groove 42 in the opposite end. However, in some embodiments, the positions of the tongues 32 and the grooves 42 are reversed. Each tongue 32 is dimensioned so that it is a tolerance fit with its respective groove 42 so that the portions 30, 40, will not become accidentally disconnected in the borehole.

The cement tools 10, 20 are connected together in the same way as the body members 30, 40; i.e. by connecting the groove 42 of the second body member 40 of the first tool 10 with the tongue 32 of the first body member 30 of the second tool 20. A connecting passage 86 joins the spiral passages 36, 46 of the body members 30, 40 together, as best shown in FIG. 9. The connecting passage 86 is preferably cylindrical, having a first axial portion 88 which extends from the (in use lower) end of spiral passage 46, a second axial portion 89 which extends from the (in use upper) end of the spiral passage 36 and a third transaxial portion 86A, 86B being a passage travelling through, and across the axis of, the cement tool 10, 20, connecting the first and second axial portions together. The first 88 and second 89 axial passage portions are formed from a pair of off-centre axially arranged cylindrical bores formed respectively through the members 40, 30 and the third transaxial passage portion 86 is formed from a transaxially arranged cylindrical bore 86 formed through the body members 30, 40 when joined together, so that the transaxial bore 86 spans the join between the body members 30, 40.

In some embodiments, transaxial passage 86 may be inclined relative to the (in use) horizontal plane, so as to continue the inclined path of spiral passages 36, 46.

Fluid flowing through the cement tools 10, 20 will be decelerated by being forced to change from axial to spiral flow.

The lower end of casing 60 is connected to a shoe 14 by means of standard screw threads. The cement tool 10 is connected inside the shoe 14 by an anti-rotation connector sub 16 (shown in FIG. 3). The connector sub 16 has a groove 42 which engages the tongue 32 of the lower end of the first cement tool 10. The connector sub 16 has a front portion 54 and a rear portion 56. Both portions 54, 56 are cylindrical but portion 56 has a larger diameter. The lower end of portion 56 tapers to a point to provide a tapered end 58. A circlip 62 is disposed in a groove in the front portion 54.

The shoe 14 has an inner bore shaped to co-operate with the outside surface of the connector sub 16. The inner bore has a narrow portion 68 with a groove 64 for engagement of the circlip 62. The inner bore of the shoe 14 also has a wider portion 69 having a V-shaped receiving surface 70 corresponding to the tapered end 58 to receive the tapered end 58.

The connector sub 16 is inserted into the shoe 14 and, once the circlip 62 is aligned with the groove 64 in the inner bore of the shoe 14, the circlip 62 expands into the groove 64. This prevents further axial movement between the shoe 14 and the connector 16 (and hence the tools 10, 20 and the rest of the apparatus).

The connector sub 16 can be inserted at any angle, as it will align itself due to the tapered end 58 mating with the V-shaped receiving surface 70. Once the circlip 62 is engaged, the tapered end 58 cannot escape from the V-shaped receiving surface 70 as the axial movement needed to do this is prevented by the engaged circlip 62. Furthermore, the connector sub cannot rotate relative to the shoe 14 due to the mating of the tapered end 58 and the V-shaped receiving surface 70. Therefore, the shoe 14 is fixed relative to the cement tools 10, 20, both rotationally and axially.

The shoe 14 has a nose 50 having outlet ports 52 to allow fluids to pass through the shoe 14 into the annulus between the casing and the borehole (not shown). The shoe 14 also typically has a one-way valve 55, to prevent fluids from flowing back into the casing string.

Figure 10:
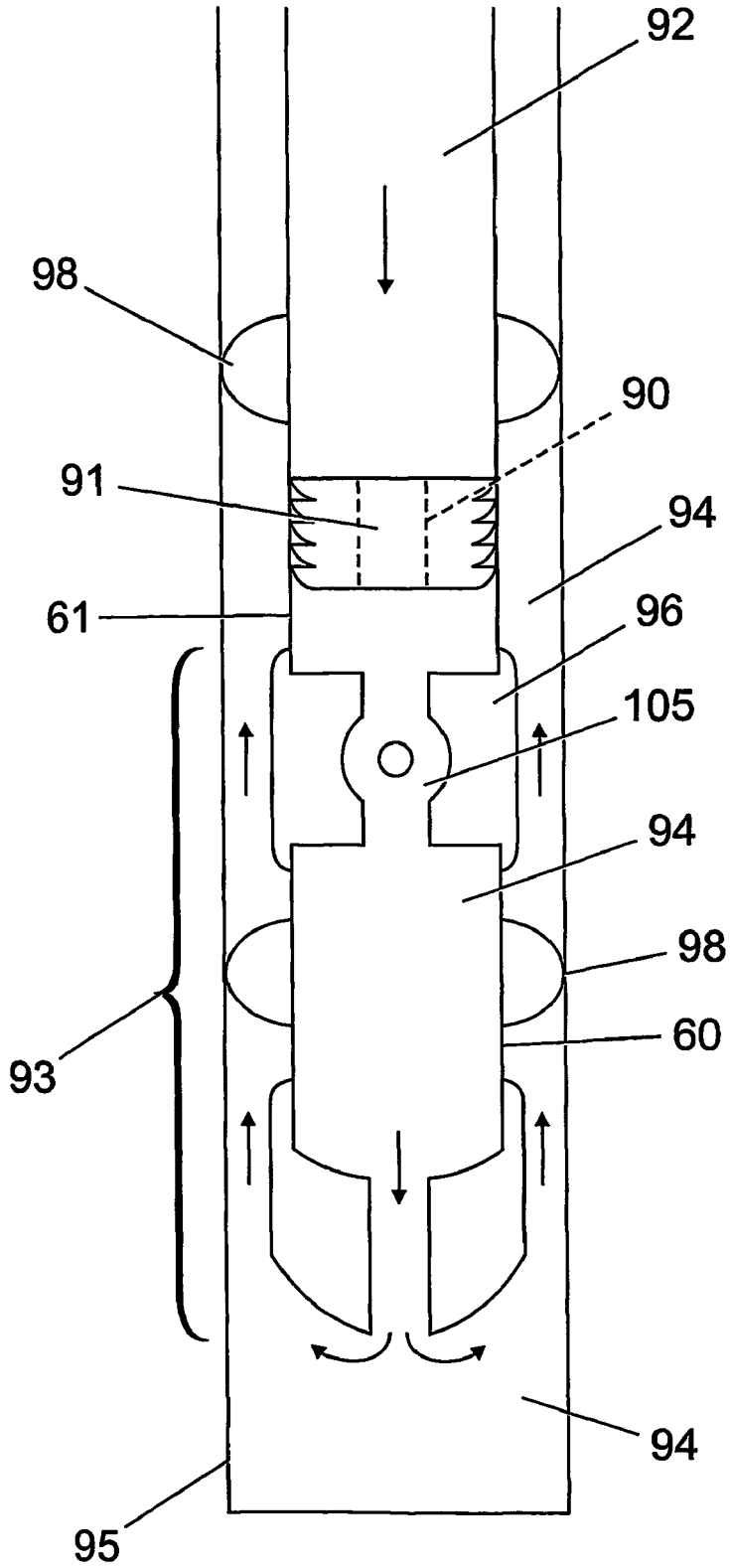
FIG. 10 shows a schematic diagram of the apparatus assembled in a borehole, with cement forcing the drilling mud through the apparatus.
Figure 11:
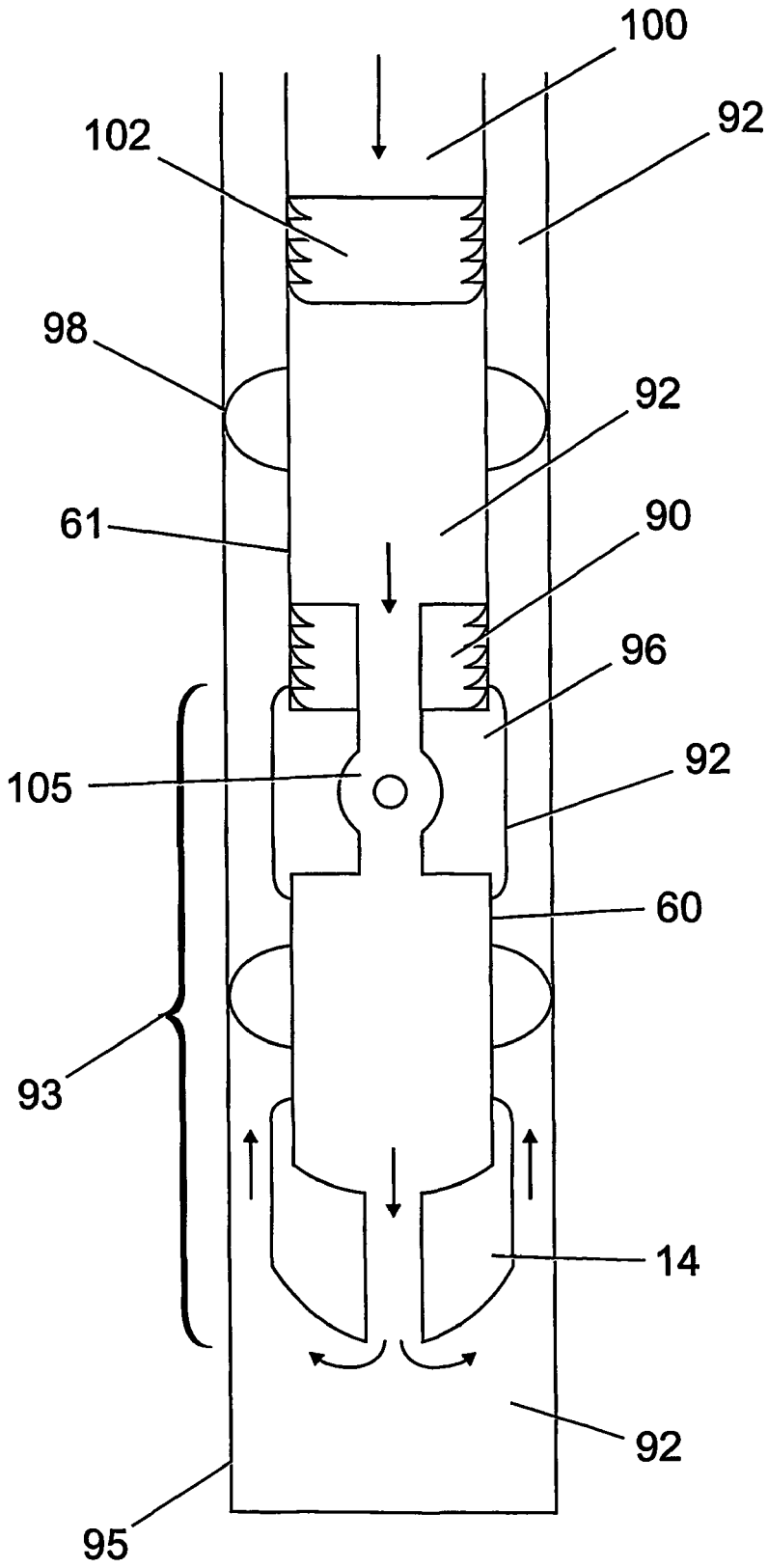
FIG. 11 shows a schematic diagram of the apparatus with displacement fluid forcing the cement through the apparatus.

The apparatus is typically used in conjunction with a float collar, as shown in FIGS. 10 and 11. In these figures, casing 60 (in which cement tools 10, 20 are located) is shown coupled beneath a float collar 96. Float collar 96 can be a standard float collar which is commercially available; such float collars usually include a valve 105, which is typically a one-way valve. For safe operation of the equipment, a valve must be provided in at least one of the float collar 96 and the shoe 14.

The cross-sectional areas of the respective passages 36, 46 inside the tools 10, 20 are preferably greater than the cross-sectional area of the valve 105. This means that the fluid flow rate is not limited by the cross-sectional area of the passages 36, 46. The fluid flow rate is only limited by the amount of turbulence created inside the tools 10, 20. Therefore the cement tools 10, 20 do not "choke" the fluid, as they do not restrict the cross-sectional area through which it flows.

FIG. 4 shows a collar 80 which can be attached to the cement tool 10, instead of the shoe 14. The collar 80 is typically used in the cases where it is not desired to connect the tools 10, 20 directly to the shoe 14, e.g. if another tool is required to be inserted above the shoe 14. However, it will also be appreciated that the cement tools 10, 20 could be placed at any suitable position in the conduit by any suitable locating device such as adhesives etc. or even by providing the outer diameters of the cement tools 10, 20 as a clearance fit with the inner diameter of the conduit. Each end of the collar 80 is screw threaded for engagement with casing 60 and for engagement with further casing (not shown). The collar 80 has an inner bore similar to that of the shoe 14 for engagement with the connector sub 58. The inner bore has a narrow portion 68 with a groove 64 for engagement of the circlip 62 and a wide portion 69, having a tapered circumference 70 corresponding to the tapered end 58. The collar 80 may be used to position the tools 10, 20 above the shoe track 93 (the shoe track is shown in FIGS. 10 and 11). (The shoe track 93 is a common term in the industry to designate the combination of a shoe, one or two joints of casing and a float collar.)

FIG. 9 shows the tool 10 having a shroud 82 around the exterior, which could be formed from an easily drillable material. The shroud 82 has apertures 84 formed in its side wall. The apertures 84 are typically distributed throughout the surface of the shroud 82.

The shoe 14, the tools 10, 20, the connector sub 16, any collar 80 and any plugs used with the apparatus are preferably made from materials which can be drilled through, such as a plastic or aluminium. The tools 10, 20 and connector sub 16 are preferably made out of a thermoplastic.

In use, the shoe 14, connector sub 16, tools 10, 20, casing 60 and casing coupling 12 are connected to form the assembly shown in FIG. 1 by engaging screw threads, tongues and grooves as described above. The assembly is then run into the borehole and drilling mud is pumped down through the casing string. When the assembly reaches the required depth, the casing is cemented in place. This is done by pumping cement down through the casing string. The cement is pumped on top of the drilling mud already in the casing string, and displaces the drilling mud, accelerating the mud down through the casing string and the tools 10, 20.

The cement may be pumped directly on top of the drilling mud, in which case it could be advantageous to start with a low density cement slurry and to gradually build up the density. Cement additives (commercially available) have been developed to control the density of the cement slurry. The density can be lowered by adding an additive which has a low specific gravity, or which allows large quantities of water (which is lighter weight than cement) to be added to the cement, or a combination of both. The lead slurry should therefore be the lightest; typically around 10 lb/gallon, followed by an intermediate slurry of around 11.5 lb/gallon, and a tail slurry of 15 lb/gallon.

In this way, full density cement is not directly on top of the drilling mud, and this reduces the probability of the cement falling through the mud. The decelerating action of the tools 10, 20, which will be detailed subsequently, also reduces the likelihood that the cement will fall through the mud.

Alternatively, as shown in FIG. 10, a plug 90 could be positioned between the drilling mud 94 and the cement 92. The plug 90 typically has a sheer section 91 which breaks on the application of a threshold pressure. In the case where the tools 10, 20 are located directly on top of the shoe 14, the plug 90 lands on top of the float collar 96. FIG. 11 shows the plug 90 landed and sheared by the pressure of the cement 92 above it. The float collar 96 typically has an anti-rotation device (not shown), such as saw tooth protrusions, to engage the plug 90 and to prevent rotation of the plug 90 when it is subsequently drilled through.

The FIG. 10 embodiment also shows the casing 60 (which contains the cement tools 10, 20) and a following casing string 61 having commercially available centralisers 98 to hold the casing 60 and the casing string 61 in the centre of the borehole 95.

In the case (not shown) where the tools 10, 20 are located above the shoe track 93 such that the tools 10, 20 would be located in the casing string 61, a landing device (not shown) is typically provided to land the plug 90. The landing device would typically have an anti-rotation device to prevent rotation of the plug, as explained above.

Before the cement puts pressure on the drilling mud, the drilling mud flows slowly enough through the tools 10, 20 for the flow to be laminar. The flow of the drilling mud is not choked by the apparatus, because the cross-sectional areas of passages 36, 46 are greater than the cross-sectional area of the valve 105 in the float collar 96. Thus, the tools 10, 20 do not restrict the flow of the drilling mud before the cement is introduced into the casing string; the only restriction on the flow of the drilling mud is the size of the valve 105.

However, when the mud is accelerated by the cement, the velocity of the mud is increased sufficiently for the drilling mud to become turbulent. As the drilling mud passes from the right-hand spiral portion 40 to the left-hand spiral portion 30, the drilling mud is forced to spiral in the opposite direction. Anticlockwise spiralling mud meets clockwise spiralling mud in the passage 86 between the portions 30, 40 such that eddy currents build up and the mud in the passage becomes turbulent. The turbulence restricts the flow of the mud through the tools 10, 20. Thus, the velocity of the mud which leaves the shoe and flows up the annulus between the casing and the formation is reduced, thereby exerting a reduced pressure on the formation and reducing the probability of the formation breaking down.

When the cement reaches the tools 10, 20, some of the cement flows through the apertures 84, which serves to cement the tools 10, 20 to the casing 60.

Cement is continued to be pumped through the casing string until all the drilling mud 94 has been expelled from the shoe 14 and the cement 92 now fills the annulus between the casing string 61 and the borehole 95. A plug 102 (see FIG. 11) is typically used to act as a separator between the cement 92 and a displacement fluid 100 (e.g. more drilling mud) used to propel the cement 92 downwards. Typically, this plug 102 lands on the float collar 96 (or the landing device, if the tools 10, 20 are located above the float collar 96), on top of any previous plug 90. Thus, when the cement 92 sets, in addition to filling the annulus, it will also fill all of the apparatus below the plug, including the tools 10, 20. If deeper drilling is required, any plugs, the tools 10, 20, any collar 80 and the shoe 14 are drilled through.

Modifications and improvements can be made without departing from the scope of the invention. For example, more or fewer tools 10, 20 may be used in combination. The plastic or aluminium shroud 82 and the anti-rotation connector sub 16 are not essential elements of the invention. For instance, the tools 10, 20 could be cemented into the casing 60, or otherwise fixed to the casing 60 or the casing coupling 12; thus obviating the need for the anti-rotation connector sub 16.

Also, left-hand and right-hand spiral portions 30, 40 need not be positioned alternately; two portions 30 could be followed by two portions 40. The tool could optionally comprise only one spiral portion, or a combination of uni-directional spiral portions. In further alternative embodiments, the spiral portions 30, 40 could be replaced by a combination of straight axially arranged portions (not shown) and circumferentially arranged portions (not shown) such that the fluid would flow around a circumferential portion at one height and then flows down the straight axially arranged portion to the next lower circumferential portion and so on.

Furthermore the spiral portions 30, 40 need not be attached by tongues and grooves; other attachment means such as screw threads could be provided. The shoe 14 could be any type of shoe such as a reamer shoe, a guide shoe or a float shoe.

The anti-rotation sub 16 is not an essential feature of the invention. In some embodiments, it is not necessary, e.g. the cement tools 10, 20 can be cemented, jammed or secured in any other way to the inside of the casing or other conduit so as to prevent rotation.

In the case where the cement tools 10, 20 are located inside drillpipe, neither the shoe 14 nor the collar 80 would be necessary. The drillpipe could be hung off (i.e. from a casing string) in such a way as to prevent rotation of the drillpipe. The cement tools 10, 20 could be dimensioned to be a clearance fit inside the drillpipe, to jam the tools 10, 20 inside the drillpipe to prevent relative rotation therebetween.

The passage 86 between spiral portions 30 and 40 could include a chamber wider than the rest of the passage in which the streams of oppositely flowing fluid could meet and interact.

Figure 12:
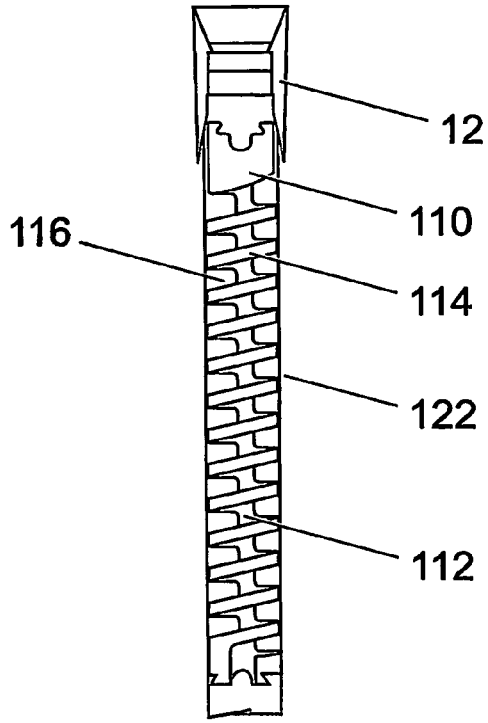
FIG. 12 shows a side view with interior detail of an alternative embodiment of the invention, including a tightly-wound spiral passage.

A further modification is shown in FIG. 12, which shows an modified cement tool 110 inserted inside a casing length 122. Casing coupling 12 is also shown; casing coupling 12 is the same as that shown in FIG. 1, and therefore the same reference number has been used.

Like the cement tools 10, 20 of the FIG. 1 embodiment, cement tool 110 has a central column 112 with a spiral protrusion 114 extending therefrom.

Spiral protrusions 114 extend substantially to the inner wall of the casing 122 and define a spiral passage 116 between the surfaces of the spiral protrusion 114, the central column 112 and the inner surface of casing 122. The spiral is typically tightly wound, so that spiral passage 116 is longer than the axial length of cement tool 110. Spiral passage 116 spirals clockwise when viewed from the (in use) upper end of cement tool 110.

As in the FIG. 1 embodiment, the spiral passage 116 permits gravity to aid the flow of fluids along the passage, and reduces the chance of any suspended particles carried by the fluid settling out and blocking the passage.

It can be beneficial if the cross-sectional area of spiral passage 116 is greater than the cross-sectional area of a typical float collar valve. In such embodiments, the passage 116 does not limit or choke the flow of fluids when used in combination with a float collar having a valve. However, alternative embodiments of the invention can have a passage with a smaller cross-sectional area than that of a float collar valve.

Although only one cement tool 110 is shown in FIG. 12, it will be appreciated that this could be attached to one or more further cement tools, e.g. by interlocking tongues and grooves, as shown in the FIG. 1 embodiment. The further cement tool may have a passage which spirals in a clockwise or anticlockwise direction.

Figure 13:
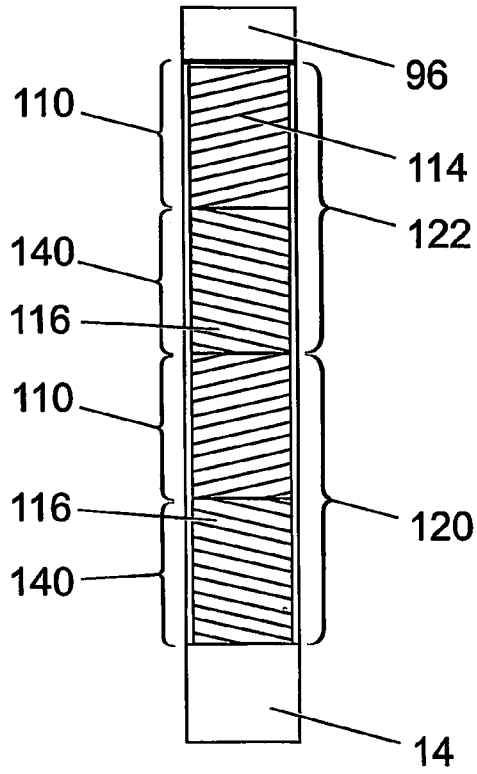
FIG. 13 shows a schematic diagram of the FIG. 12 embodiment of the invention located in a casing string between a float collar and a float shoe.

FIG. 13 shows a schematic diagram of an assembly including two types of cement tool 110, 140. In this embodiment, two lengths of casing 122, 120 are connected together between float collar 96 and shoe 14. However, the invention is not limited to use in conjunction with a either a float collar or shoe.

Cement tool 110 is the one shown in detail in FIG. 12. Cement tool 140 is similar to cement tool 110, also having spiral protrusions 114 which define a spiral passage 116. However, the direction of spiral passage in cement tool 140 is reversed; this passage is spiralling anticlockwise when viewed from the (in use) upper end of the cement tool.

A first pair of cement tools 110, 140 are connected together; these are also connected to a second pair of cement tools 110, 140. In this embodiment, each cement tool 110, 140 is half as long as a length of casing, so that the two pairs of cement tools 110, 140 fill both casing lengths 120, 122. In this schematic diagram, diagonal lines indicate the spiral protrusions 114 and the direction of spiral, but the full details of the cement tools 110, 140 are not shown.

However, it will be appreciated that the length of each cement tool 110 is not important, and a greater number of shorter cement tools, or a smaller number of longer cement tools could equally be used. A yet alternative arrangement is shown in schematic form in FIG. 14, wherein a single, longer cement tool 150 is located inside casing length 120. Cement tool 150 is of the same form as cement tool 110 shown in detail in FIG. 12, only longer. Thus, this embodiment causes fluid to spiral in one direction only. In this embodiment, no cement tool is located inside casing 122, which is empty.

Figure 14:
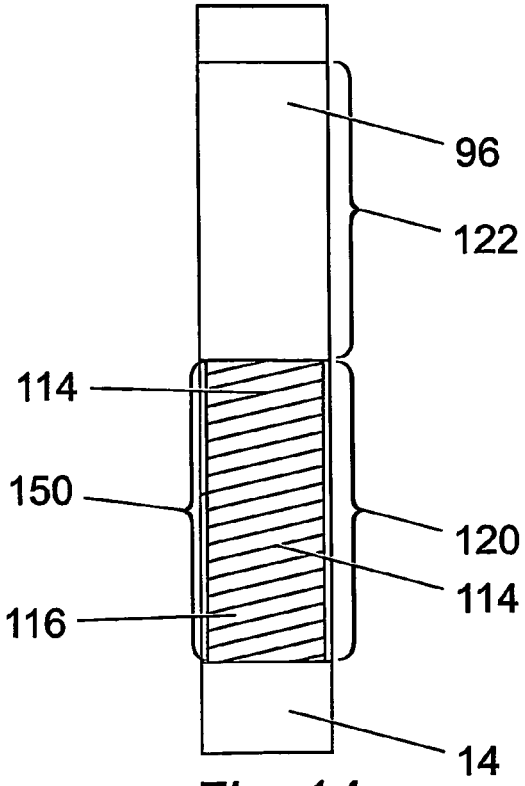
FIG. 14 shows a schematic diagram of an alternative arrangement to FIG. 13, having a spiral passage spiralling in one direction only.

As with the FIG. 1 embodiment, a shroud (see FIG. 9) can optionally be provided around cement tool 110, although this detail is not shown in FIGS. 12 to 14.

In the embodiments of FIGS. 12 to 14, spiral passage 116 between spiral protrusions 114 is long and tightly wound. Therefore, the total length of spiral passage (i.e. made up of the combined lengths of the passages 116 of all of the cement tools 110, 140 used) is considerably longer than (and may be many times as long as) the length of casing in which the cement tools 110, 140 are located.

In use, cement tools 110, 140 are fitted together and assembled inside the casing lengths 122, 120 as required between float shoe 14 and float collar 96. Cement is then pumped down the inside of the casing. The details of this are the same as described above with reference to the previous embodiment, e.g. the first portion of cement is typically low density cement slurry, and the density is then gradually built up to full density to reduce the likelihood of the cement "falling through" the drilling mud. Alternatively or additionally, a plug with a sheer section (such as plug 90 in FIG. 10) can be used to keep the cement and the drilling mud separate until plug 90 lands on float collar 96.

The cement pushes the drilling mud through the cement tools 110, 140. The drilling mud is forced to continually change direction to follow the spiral passage 116. The tighter the spiral, the greater the decelerating effect. Friction with the inside of the casing (or optional protective shroud) and spiral protrusions 114 decelerates the drilling mud. Thus, the embodiments shown in FIGS. 12 to 14 can decelerate a fluid with or without any additional deceleration caused by turbulence.

The drilling mud is propelled out of shoe 14 and up the annulus between the outside of casing lengths 122, 120 and the borehole. However, as its speed has been reduced by cement tools 110, 140, the pressure on the formation is eased, rendering the formation less likely to collapse.

The invention claimed is:

1. A flow control insert for a downhole string including a shoe, the flow control insert being formed separately from the downhole string and being adapted to be inserted within the downhole string above the shoe;

wherein the flow control insert is adapted to decelerate the flow of fluid through the downhole string;

wherein the flow control insert comprises a passage which includes at least one spiral portion which spirals in a first spiral direction and at least one further portion which spirals in a second spiral direction opposite to the first spiral direction; and wherein a cavity is provided between the two spiral portions.

2. A flow control insert as claimed in claim 1, wherein the passage is defined by at least one body member having formations thereon.

3. An assembly comprising a flow control insert as claimed in claim 2, and a shoe adapted for engagement with the at least one body member.

4. An assembly as claimed in claim 3, including an anti-rotation means to prevent relative rotation of the at least one body member and the shoe.

5. An assembly as claimed in claim 4, wherein the anti-rotation means includes a device shaped to engage a bore provided in the shoe.

6. An assembly as claimed in claim 5, including an axial locking means to prevent axial separation of the device and the shoe.

7. An assembly as claimed in claim 6, wherein the axial locking means comprises a latch provided on one of the device and the shoe, and a groove provided on the other of the device and the shoe.

8. An assembly as claimed in claim 5, also including an axial locking means to prevent axial separation of the device and the shoe, and wherein the anti-rotation means prevents relative rotation of the at least one body member and the shoe once the axial locking means has engaged.

9. An assembly as claimed in claim 4, wherein the anti-rotation means comprises a tapered edge provided on one of the device and the shoe and a correspondingly shaped groove provided on the other of the device and the shoe.

10. A flow control insert as claimed in claim 2, wherein the apparatus includes a shroud which is disposed around the at least one body member.

11. A flow control insert as claimed in claim 10, wherein the shroud is provided with apertures in the side wall thereof.

12. A flow control insert as claimed in claim 1, wherein the spiral portions of the passage have constant dimensions.

13. A flow control insert as claimed in claim 1, wherein the boundaries of the passage are smooth and free of obstructions.

14. A flow control insert as claimed in claim 1, wherein deceleration of the fluid is caused by friction between the fluid and the spiral portions of the passage.

15. A flow control insert as claimed in claim 1, wherein the flow control insert has a central column and wherein the spiral portions of the passage spiral around the central column.

16. A flow control insert as claimed in claim 1, wherein the downhole string has a longitudinal axis, and wherein the angle of the spiral portions of the passage is more than 60 degrees relative to the longitudinal axis of the downhole string.

17. A flow control insert as claimed in claim 1, wherein the downhole string has a longitudinal axis, and wherein the angle of the spiral portions of the passage is between 70 degrees and 80 degrees relative to the longitudinal axis of the downhole string.

18. A flow control insert as claimed in claim 1, wherein the flow control insert is adapted to induce turbulence into the fluid.

19. A flow control insert as claimed in claim 1, wherein the flow control insert is adapted to induce turbulence into the fluid in the cavity between the at least two oppositely-directed spiral passage portions.

20. A flow control insert as claimed in claim 1, wherein the downhole string is selected from the group consisting of drillpipe, tubing, coiled tubing, filtration screen, casing and liner string.

21. A control assembly, including:

control apparatus for controlling the flow of fluid into a borehole through a downhole string, wherein the control apparatus is adapted to decelerate the flow of fluid through the downhole string, the control apparatus having a passage therethrough, the passage including at least one spiral portion which spirals in a first spiral direction and at least one further portion which spirals in a second spiral direction opposite to the first spiral direction and wherein a cavity is provided between the two spiral portions;

a downhole string in which the control apparatus is located, the downhole string having a shoe, wherein the control apparatus is formed separately from the downhole string and is located in the downhole string above the shoe;

a valve located in the downhole string above the control apparatus;

wherein the cross-sectional area of the passage in the control apparatus is greater than the cross-sectional area of the valve.

22. An assembly as claimed in claim 21, wherein the valve is located in a float collar.

23. A method of controlling the passage of fluid through a downhole string located in a borehole, the downhole string including a shoe, the downhole string having a longitudinal axis;

wherein the method includes:

inserting a separately-formed flow control insert within the downhole string, above the shoe, wherein the flow control insert comprises a passage which includes at least one spiral portion which directs fluid passing through it in a first spiral direction and at least one further portion which directs fluid passing through it in a second spiral direction opposite to the first spiral direction and wherein fluid passing between the first and second spiral portions is directed through a cavity provided between the two spiral portions; and decelerating the fluid through the flow control insert;

wherein the flow control insert causes the fluid to change direction from an axial direction to the first spiral direction as it flows into the first spiral portion, and from the first spiral direction to the second spiral direction as the fluid flows through the cavity and into the second spiral portion.

24. A method as claimed in claim 23, including the step of causing the fluid to deviate from the downhole string into a passage which is inclined relative to the longitudinal axis of the downhole string.

25. A method as claimed in claim 24, wherein the fluid is decelerated by friction between the fluid and the boundaries of the inclined passage.

26. A method as claimed in claim 24, wherein the inclined passage has constant dimensions and the boundaries of the passage are free of obstructions so that the fluid moves along the passage without hindrance.

27. A method as claimed in claim 24, wherein a float collar having a valve is provided in the downhole string above the inclined passage, and wherein the passage has a greater cross-sectional area than the cross-sectional area of the valve so that the fluid flows without restriction into the passage.

28. A method as claimed in claim 24, wherein the inclined passage is defined by at least one body member having formations thereon and wherein a shroud having apertures in its surface is provided around the body member, the method including the step of passing cement through the passage, so that some of the cement exits the passage via the apertures to cement the body member to the downhole string.

29. A method as claimed in claim 24, wherein the fluid is caused to travel in a tight spiral so that it travels through a large distance in a small axial space.

30. A method as claimed in claim 23, including the step of inducing turbulence into the fluid.

31. A method as claimed in claim 30, wherein turbulence is induced by causing the fluid to change direction from the first spiral direction to the second spiral direction.

32. A flow control assembly comprising:

a downhole string, including a shoe at a lower end thereof; and a flow control insert located within the downhole string above the shoe, the flow control insert being adapted to decelerate the flow of fluid through the downhole string, wherein the flow control insert is formed separately from the downhole string and has a passage therethrough which includes at least one spiral portion which spirals in a first spiral direction and at least one further spiral portion which spirals in a second spiral direction, wherein the second spiral direction is opposite to the first spiral direction, and wherein a cavity is provided between the two spiral portions.

* * * * *